US010573217B2

(12) United States Patent
Johnson

(10) Patent No.: US 10,573,217 B2
(45) Date of Patent: Feb. 25, 2020

(54) PIXEL DESIGN AND METHOD TO CREATE FORMATS WHICH EXTENDS OLED LIFE

(71) Applicant: Rockwell Collins, Inc., Cedar Rapids, IA (US)

(72) Inventor: Ricky J. Johnson, Shellsburg, IA (US)

(73) Assignee: ROCKWELL COLLINS, INC., Cedar Rapids, IA (US)

( * ) Notice: Subject to any disclaimer, the term of this patent is extended or adjusted under 35 U.S.C. 154(b) by 0 days.

(21) Appl. No.: 15/656,505

(22) Filed: Jul. 21, 2017

(65) Prior Publication Data

US 2019/0027080 A1 Jan. 24, 2019

(51) Int. Cl.

| | |
|---|---|
| ***G09G 3/20*** | (2006.01) |
| ***G09G 3/3258*** | (2016.01) |
| ***G09G 3/3233*** | (2016.01) |

(52) U.S. Cl.

CPC ..... *G09G 3/2003* (2013.01); *G09G 3/3233* (2013.01); *G09G 3/3258* (2013.01); *G09G 2300/0443* (2013.01); *G09G 2300/0452* (2013.01); *G09G 2320/0233* (2013.01); *G09G 2320/0242* (2013.01); *G09G 2320/046* (2013.01); *G09G 2320/0686* (2013.01)

(58) Field of Classification Search

CPC ... G09G 2300/0452; G09G 2320/0242; G09G 2320/046; G09G 2300/0443; G09G 3/3258; G09G 3/3233; G09G 3/2003; G09G 3/2074; G09G 3/2983; G09G 2300/0439

See application file for complete search history.

(56) References Cited

U.S. PATENT DOCUMENTS

| | | | | |
|---|---|---|---|---|
| 2015/0015590 | A1* | 1/2015 | Jeong | G09G 3/2003 345/502 |
| 2016/0027404 | A1* | 1/2016 | Nakanishi | G09G 5/02 345/590 |
| 2016/0189671 | A1* | 6/2016 | Kim | G09G 3/3291 345/690 |
| 2017/0069290 | A1* | 3/2017 | Lee | G09G 3/2003 |
| 2017/0092168 | A1* | 3/2017 | Peana | G09G 3/007 |

* cited by examiner

*Primary Examiner* — Dennis P Joseph

(74) *Attorney, Agent, or Firm* — Donna P. Suchy; Daniel M. Barbieri

(57) ABSTRACT

A display system includes an organic light emitting diode (OLED) display and a controller. The display includes an array of pixels, each pixel comprising a first group of subpixels and a second group of subpixels. The first group of subpixels includes single subpixels of different colors. The second group of subpixels includes one or more subgroups of subpixels, where each subgroup includes a plurality of subpixels of the same color. The controller is configured to provide a voltage to the first group of subpixels and to at least one of the subpixels of each subgroup of subpixels according to a first data format. The controller is configured to provide a voltage to at least another of the subpixels of each subgroup of subpixels, and not to the first group of subpixels, according to the second data format.

20 Claims, 4 Drawing Sheets

PIXEL DESIGN AND METHOD TO CREATE FORMATS WHICH EXTENDS OLED LIFE

The inventive concepts disclosed herein generally relate to the field of organic light emitting diodes (OLEDs), and displays employing OLEDs, and other emissive displays.

BACKGROUND

OLED displays have an advantage over other displays, such as liquid crystal diode (LCD) displays, which require a backlight. OLED color displays generally comprise an array of pixels, where each pixel has a plurality of subpixels, and each of the subpixels for a particular pixel is of a different color. Different color schemes, such as RGB (red, green, blue) or RGBY (red, green, blue, yellow), are employed for OLED displays. In operation, a respective voltage is applied to each of the subpixels, where the luminance of a subpixel increases with the voltage applied.

The luminance of the OLED subpixels degrades with time. In particular, for a RGB subpixel arrangement, the blue subpixels degrade faster than the red or green subpixels, although all of the subpixels colors degrade. The degradation of the subpixel luminance may result in image burn in.

Burn in may occur in flight displays including OLED displays, for example. Flight displays typically have a large region representing the sky which is bright blue. The blue subpixels in the blue sky region may degrade causing visible burn in. While burn in for a single color region of a display may be reduced in the case where the color region is of a small size by shifting the image on the display, since the blue sky area is relatively large shifting the images does not avoid blue subpixel burn in for the blue sky area.

SUMMARY

In one aspect, embodiments of the inventive concepts disclosed herein are directed to a display system. The display system includes an OLED display and a controller. The OLED display includes an array of pixels. Each pixel includes a first group of subpixels and a second group of subpixels. The first group of subpixels includes single subpixels of different colors. Each of the single subpixels in the first group has a different color than any other of the subpixels in the first group. The second group of subpixels includes one or more subgroups of subpixels. Each subgroup includes a plurality of subpixels of the same color. All of the pixels of each subgroup have a different color than any of the colors of the first group and any of the colors of any other subgroup. The controller is configured to provide a voltage or current to each subpixel of the OLED display according to a plurality of data formats. According to a first data format, the controller is configured to provide a voltage or current to the first group of subpixels and to at least one of the subpixels of each subgroup of subpixels. According to the second data format, the controller is configured to provide a voltage or current to at least another of the subpixels of each subgroup of subpixels, and not to the first group of subpixels.

In one aspect, embodiments of the inventive concepts disclosed herein the display may be generally an emissive display.

In a further aspect, embodiments of the inventive concepts disclosed herein are directed to a display system. The display system includes an emissive display comprising an array of pixels and a controller. Each pixel includes three or more subgroups of subpixels, each subgroup comprising a plurality of subpixels of the same color. All of the pixels of each subgroup have a different color than any of the colors of any other subgroup. The controller is configured to provide a voltage or current to each subpixel of the emissive display according to a plurality of data formats. According to a first data format, the controller is configured to provide a voltage or current to at least one of the subpixels of each subgroup of subpixels. According to the second data format, the controller is configured to provide a voltage or current to at least another of the subpixels of each subgroup of subpixels.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Embodiments of the inventive concepts disclosed herein regarding OLED display system provide a subpixel arrangement and selective subpixel voltage application according to data format which can reduce subpixel burn in. In particular, the selected application of voltages to certain subpixels according to a first data format or a second data format provides advantages in reducing burn in of subpixels. For example, burn in of blue subpixels may be reduced in the case where the second data format includes data for vector colors and blue sky, while the first data includes data for charts and video, and each pixel includes multiple blue subpixels in a subgroup. In this case, for each pixel one of the blue subpixels is controlled based on the second format, including data for vector colors and sky, which is susceptible to burn in. Another of the blue subpixels of the subgroup, however, is controlled based on first data including data for charts and video, and is less susceptible to burn in. Thus, the control of the pixels provides that each pixel has at least one of the blue subpixels which is controlled according to a format that is not susceptible to burn in.

Figure 1:
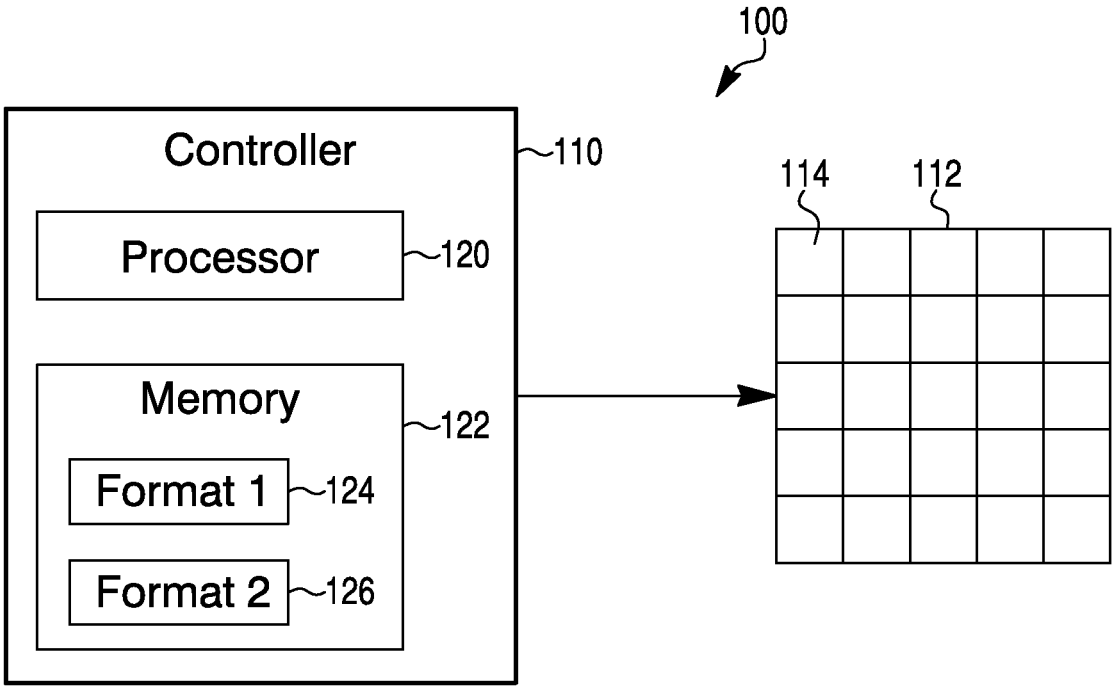
FIG. 1 illustrates a display system according to embodiments of the inventive concepts disclosed herein.
Figure 2:
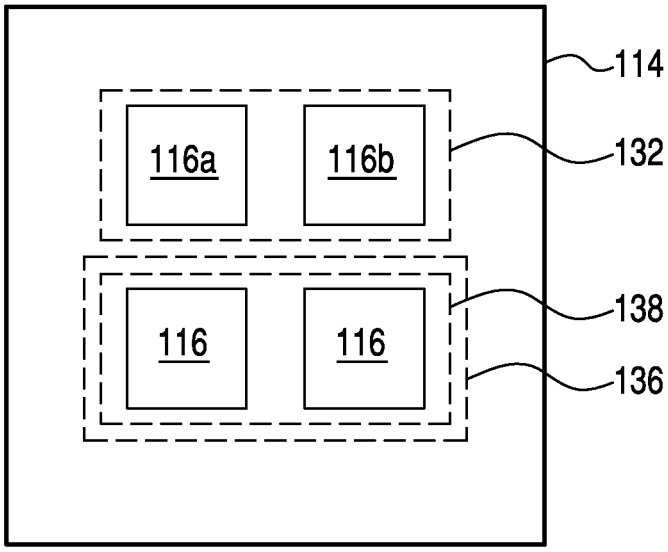
FIG. 2 illustrates a pixel with a subpixel arrangement according to an embodiment of the inventive concepts disclosed herein.

FIG. 1 illustrates an embodiment of a display system 100 according to inventive concepts disclosed herein. The display system 100 includes a controller 110 and a OLED display 112. The display 112 includes an array of pixels 114. Each of the pixels 114 includes a plurality of subpixels 116, as shown in FIG. 2. The controller 110 provides a voltage to each of the subpixels 116. The luminance of a subpixel 116 increases with the voltage applied. FIG. 1 shows 5×5 array of pixels 114 for ease of explanation, In general the array of pixels 114 will be much larger than 5×5.

The controller 110 may include a processor 120 and a memory 122. The processor 120 controls voltage to be applied to the subpixels 116, according to image data and the data format or formats for the image data. The memory 122 of the controller 110 may include instructions for operation of the processor 120 of the controller. The memory 122 may further store the image data and format therefore. FIG. 1 illustrates an example where the memory 122 stores the image data for a first format in a first format region 124 and image data for a second format in a second format region 126. The number of data formats and corresponding format regions in the memory is not limited to two, and may be more than two. For a particular image to be displayed on the OLED display 112 at a particular time, each of the subpixels 116 will correspond to one of the data formats.

FIG. 2 illustrates an embodiment illustrating a pixel 114 having a plurality of subpixels 116 according to inventive concepts disclosed herein. The subpixels 116 in FIG. 2 are not shown to scale or to show the relative position of the subpixels, but are to show the grouping of the subpixels. The subpixels 116 may be of various color formats. For example, the subpixels may be of a RGB color format where each subpixel 116 is one of a red, green, or blue color. Alternatively, the subpixels may be of a RGBY color format where each subpixel 116 is one of a red, green, blue, or yellow color. As another alternative, the subpixels may be of a CMYB color format where each subpixel 116 is one of a cyan, magenta, yellow, or black color.

The subpixels 116 are arranged in a first group of subpixels 132 and a second group of subpixels 136. The first group of subpixels 132 comprises single subpixels of different colors. For example, in FIG. 2, the first group of subpixels 132 comprises single subpixel 116*a* and single subpixel 116*b*, where subpixel 116*a* and subpixel 116*b* are of different colors from each other.

The second group of subpixels 136 comprises one or more subgroups of subpixels 138, where each subgroup 138 comprises subpixels of the same color. For example, in FIG. 2, there is a single subgroup 138 of subpixels, where the subgroup has two pixels 116, which are of the same color as each other.

All of the subpixels 116 of each subgroup 138 has a different color than any of the colors of the first group 132 and any of the colors of any other subgroup 138. For example, in the arrangement of FIG. 2, the two subpixels 116 of the single subgroup 138 are of a different color than the single subpixel 116*a* and single subpixel 116*b* in the first group 132. For example, the single subpixel 116*a* and the single subpixel 116*b* may be red and green, respectively, while the two subpixels 116 of the single subgroup 138 may be blue. Alternatively, the single subpixel 116*a* and the single subpixel 116*b* may be red and blue, respectively, while the two subpixels 116 of the single subgroup 138 may be red. As another alternative, the single subpixel 116*a* and the single subpixel 116*b* may be red and blue, respectively, while the two subpixels 116 of the single subgroup 138 may be green.

Referring back to FIG. 1, the controller 110 is configured to provide a voltage or current to each subpixel (116 in FIG. 2) of the OLED display 112 according to a plurality of data formats. For example, the data formats may include a first data format and a second data format as shown in FIG. 1.

The controller 110 is configured to provide a voltage or current to some of the subpixels 116 according to the first format, and to provide a voltage or current to other of the subpixels 116 according to the second format. Specifically, according to the first format, the controller 116 is configured to provide a voltage or current to the first group of subpixels 132 and also to at least one of the subpixels of each of the subgroups 138. For example, for the arrangement of FIG. 2, the controller 116 is configured to provide a voltage or current to the subpixel 116*a* and the subpixel 116*b* of the first group of subpixels 132 and also to one of the subpixels 116 of the single subgroups 138.

According to the second format, the controller 116 is configured to provide a voltage or current to another of the subpixels of each of the subgroups 138, but not to subpixels of the first group of subpixels 132. For example, for the arrangement of FIG. 2, the controller 116 is configured to provide a voltage or current to another of the subpixels 116 of the single subgroups 138, but not to subpixels of the first group of subpixels 132.

This selected application of voltage or current according to a first data format or a second data format provides advantages in reducing burn in of subpixels according to embodiments of the inventive concepts disclosed herein. For example, burn in of blue subpixels may be reduced in the case where the second data format includes data for vector colors and blue sky, while the first data includes data for charts and video, and the subgroup 138 of subpixels are blue. In this case, for each pixel one of the blue subpixels of the subgroup 138 is controlled based on the second format, including data for vector colors and sky, which is susceptible to burn in. Another of the blue subpixels of the subgroup 138, however, is controlled based on first data including data for charts and video, and is not susceptible to burn in. Thus, the control of the pixels 114 provides that each pixel has at least one of the blue subpixels which is controlled according to a format that is not susceptible to burn in.

Figure 3:
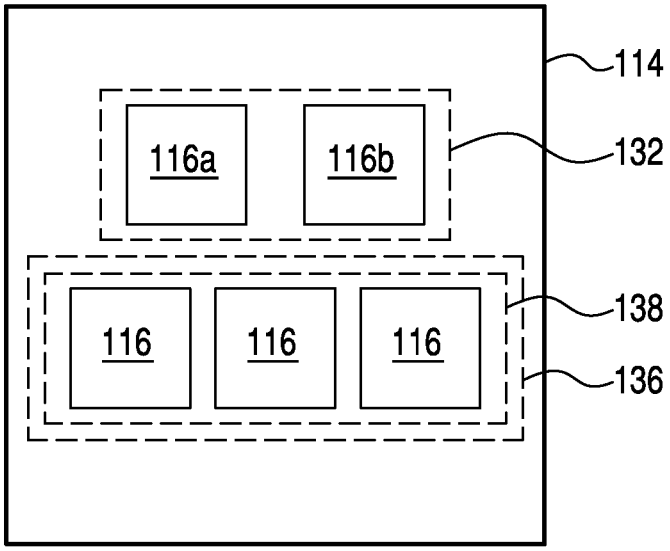
FIG. 3 illustrates a pixel with a subpixel arrangement according to another embodiment of the inventive concepts disclosed herein.

FIG. 3 illustrates an arrangement of a pixel 14 having a plurality of subpixels 116 in another embodiment according to the inventive concepts disclosed herein. The subpixels 116 in FIG. 3 are not shown to scale or to show the relative position of the subpixels, but are to show the grouping of the subpixels. In a similar fashion to the subpixel 116 arrangement of FIG. 2, the subpixels 116 are arranged in a first group of subpixels 132 and a second group of subpixels 136. The first group of subpixels 132 comprise single subpixels of different colors. For example, in FIG. 3, the first group of subpixels 132 comprises single subpixel 116*a* and single subpixel 116*b*, where subpixel 116*a* and subpixel 116*b* are of different colors from each other.

In FIG. 3, the second group of subpixels 136 comprises a single subgroup of subpixels 138, where each subpixel of the subgroup 138 is of the same color. In FIG. 3, the single subgroup 138 of subpixels has three pixels 116, which are of the same color as each other. The color of the subpixels 116 of the subgroup 138 is different than the color of any of the subpixels 116 of the first group 132.

In controlling the applied voltage or current to each subpixel 116 of the pixel 114 of FIG. 3, the controller 110 provides a voltage or current to at least one of the three subpixels 116 in the subgroup 138 and to the two subpixels 116*a* and 116*b* of the first group according to the first data format. The controller 110 further provides a voltage or current to at least another one of the three subpixels 116 in the subgroup 138 according to the second data format. For an RGB format, the three subpixels 116 in the subgroup 138 may all be of the same color of red, green or blue.

Figure 4:
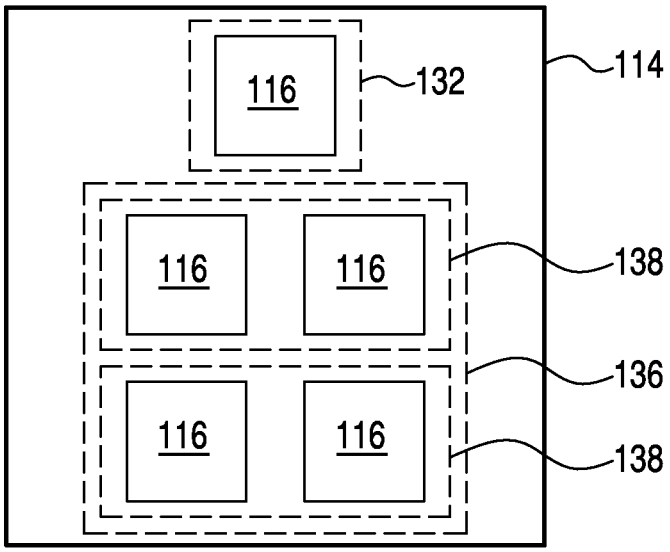
FIG. 4 illustrates a pixel with a subpixel arrangement according to another embodiment of the inventive concepts disclosed herein.

FIG. 4 illustrates an arrangement of a pixel 14 having a plurality of subpixels 116 in another embodiment according to the inventive concepts disclosed herein. The subpixels 116 in FIG. 4 are not shown to scale or to show the relative position of the subpixels, but are to show the grouping of the subpixels. In a similar fashion to the subpixel 116 arrangement of FIG. 2, the subpixels 116 are arranged in a first group of subpixels 132 and a second group of subpixels 136. The first group of subpixels 132 comprises a single subpixel 116.

In FIG. 4, the second group of subpixels 136 comprises two subgroups of subpixels 138, where each subpixel 116 of a particular subgroup 138 is of the same color. In FIG. 3, each of the two subgroups 138 of subpixels has two subpixels 116, which are of the same color as each other. The color of the subpixels 116 of each of the two subgroups 138 is different than the color of the single subpixel 116 of the first group 132, and is also different than the color of the subpixels 116 of the other subgroup 138.

In controlling the applied voltages or currents to each subpixel 116 of the pixel 114 of FIG. 4, the controller 110 provides a voltage or current to the single pixel 116 of the first group 132, and to one of the two subpixels 116 in each subgroup 138, according to the first data format. The controller 110 further provides a voltage to the other one of the two subpixels 116 in each subgroup 138 according to the second data format. For an RGB format, the two subpixels 116 in one of the two subgroups 138 may all be of the same color of red, green or blue, while the two subpixels 116 in another one of the two subgroups 138 may all be of the same color of red, green or blue. The color of the two subpixels 116 in one of the two subgroups 138, however, will be different than the two subpixels 116 in the other of the two subgroups 138.

Figure 5:
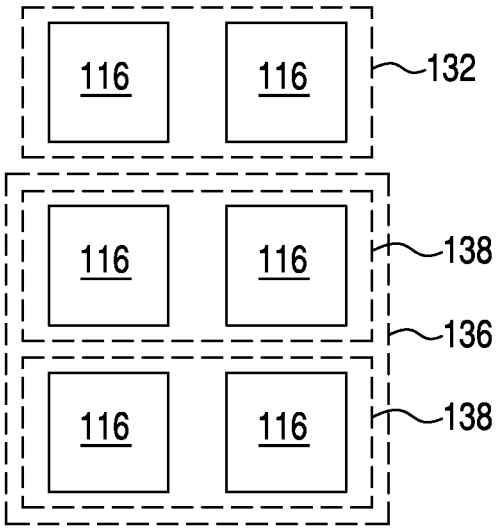
FIG. 5 illustrates a pixel with a subpixel arrangement according to another embodiment of the inventive concepts disclosed herein.

FIG. 5 illustrates an arrangement of a pixel 114 having a plurality of subpixels 116 in another embodiment according to the inventive concepts disclosed herein. The subpixels 116 in FIG. 5 are not shown to scale or to show the relative position of the subpixels, but are to show the grouping of the subpixels. In a similar fashion to the subpixel 116 arrangement of FIG. 2, the subpixels 116 are arranged in a first group of subpixels 132 and a second group of subpixels 136. The first group of subpixels 132 comprises subpixels 116*a* and 116*b*, which are of different colors.

In FIG. 5 the second group of subpixels 136 comprises two subgroups of subpixels 138, where each subpixel 116 of a particular subgroup 138 is of the same color. In FIG. 3, each of the two subgroups 138 of subpixels has two subpixels 116, which are of the same color as each other. The color of the subpixels 116 of each of the two subgroups 138 is different than the color of the subpixel 116*a* or the subpixel 116*b* of the first group 132, and is also different than the color of the subpixels 116 of the other subgroup 138.

In controlling the applied voltages or currents to each subpixel 116 of the pixel 114 of FIG. 5, the controller 110 provides a voltage or current to the subpixel 116 and the subpixel 116*b* of the first group 132, and to one of the two subpixels 116 in each subgroup 138, according to the first data format. The controller 110 further provides a voltage or current to the other one of the two subpixels 116 in each subgroup 138 according to the second data format. For an RGBY format, the two subpixels 116 in one of the two subgroup 138 may all be of the same color of red, green, blue, or yellow, while the two subpixels 116 in another one of the two subgroups 138 may all be of the same color of red, green, blue, or yellow. The color of the two subpixels 116 in one of the two subgroups 138, however, will be different than the two subpixels 116 in the other of the two subgroups 138.

According to another embodiment of the inventive concepts disclose herein. Each pixel does not include first and second groups, but rather includes three or more subgroups of subpixels, where each subgroup comprising a plurality of subpixels of the same color. All of the pixels 114 of each subgroup have a different color than any of the colors of any other subgroup. For example, the subpixels may have three subgroups, a red subgroup of red subpixels, a green subgroup of green subpixels, and a blue subgroup of blue subpixels.

The controller 110 provides a voltage or current to the subpixels according to a plurality of data formats. According to the first data format, the controller 110 is configured to provide a voltage or current to at least one of the subpixels of each subgroup of subpixels, for example, one red subpixel, one green subpixel and one blue subpixel. According to the second data format, the controller is configured to provide a voltage or current to at least another of the subpixels of each subgroup of subpixels, for example, another red subpixel, another green subpixel and another blue subpixel.

Figure 6:
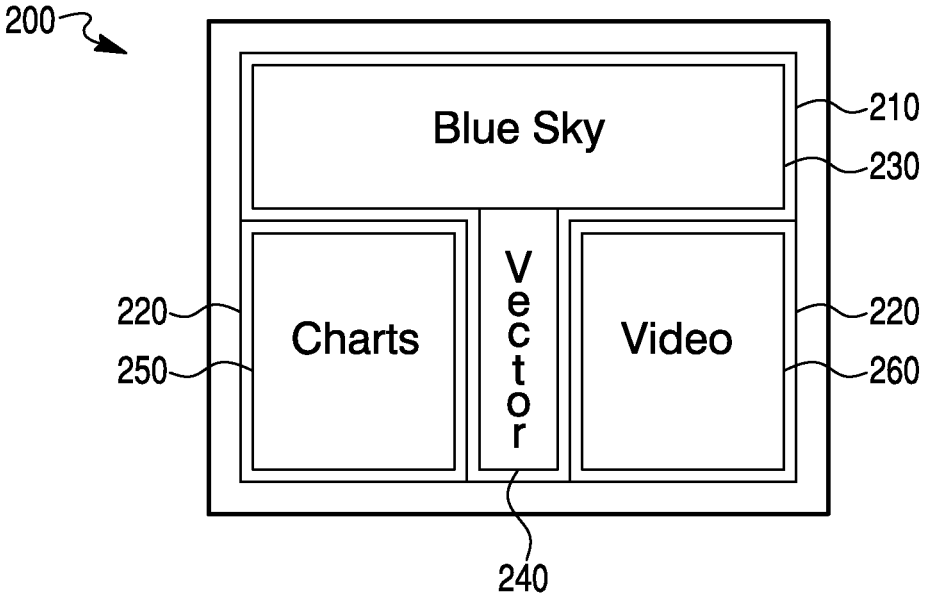
FIG. 6 illustrates a display divided into data format regions and subregions according to embodiments of the inventive concepts disclosed herein.

FIG. 6 illustrates a display 200 at a particular moment in time divided into a first data format region 210 and a second data format region 220. The pixels in the first data format region 210 have their subpixels actuated according the first data format. Similarly, the pixels in the second data format region 210 have their subpixels actuated according the second data format. FIG. 6 illustrates a display 200 with two data formats. In general, the number of data formats on the display may be more than two.

The first data format region 210 and the second data format region 220 may further be divided into subregions. For example, the first data format region 210 may further be divided into a blue sky subregion 230 and a vector subregion 240. The blue sky subregion 230 displays the blue sky. The vector subregion 240, on the other hand displays vector colors. As another example, the second data format region 220 may further be divided into a charts subregion 250 and a video subregion 260. The charts subregion 250 displays charts. The video subregion 260, on the other hand displays video.

As noted above, FIG. 6 illustrates a display 200 at a particular moment in time. In general the data format regions and sub regions may shift with time.

FIG. 6 illustrates the first data format region 210, and the blue sky subregion 230, vector subregion 240, charts subregion 250 and the video subregion 260 to be contiguous regions. The first data format region 210, and the blue sku subregion 230, the vector subregion 240, the charts subregion 250 and the video subregion 260, however, may be non-contiguous regions. Further, FIG. 6 illustrates the second data format region 220 to be a non-contiguous region. The second data format region 220, however, may be a contiguous region.

Figure 7:
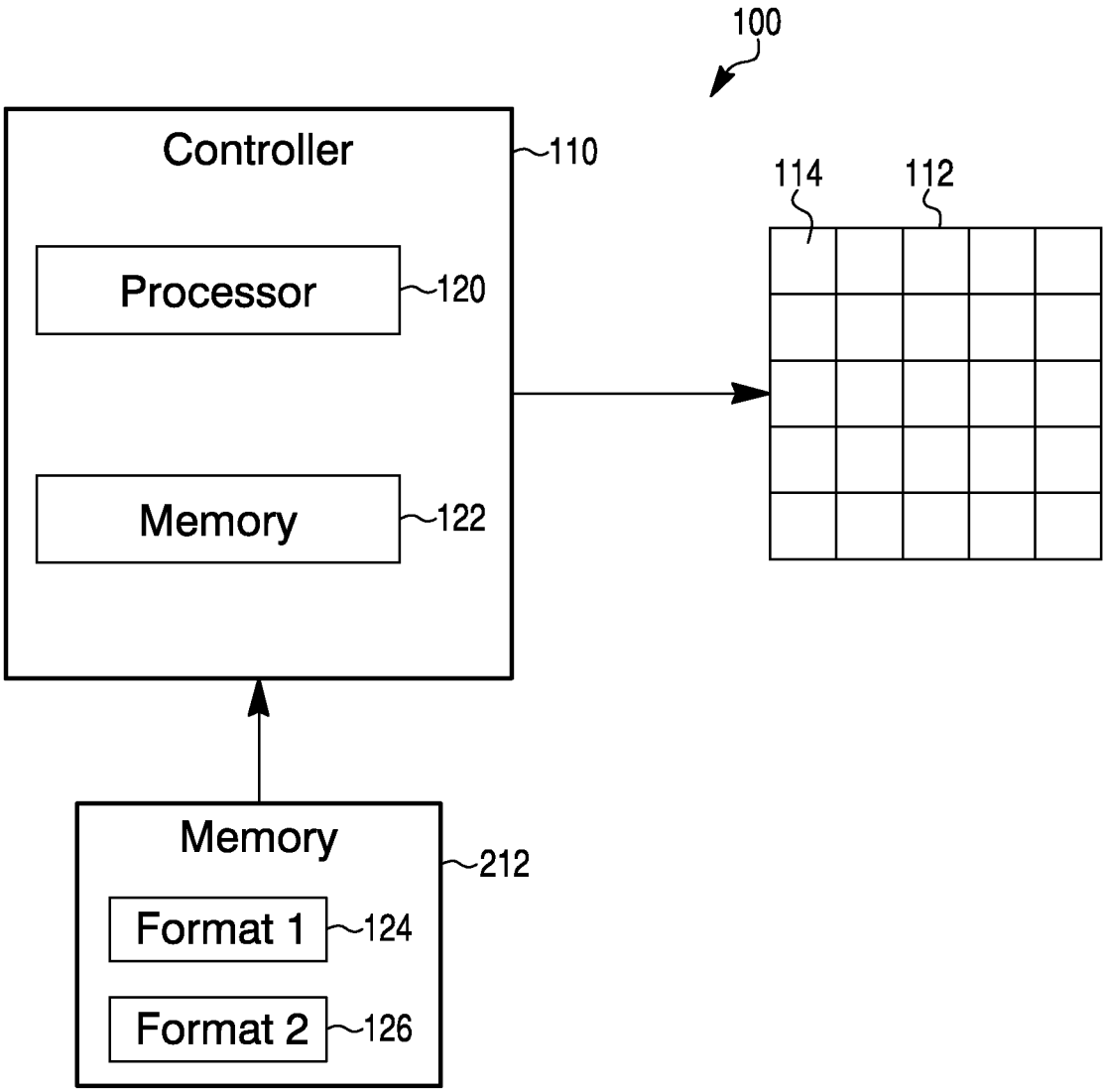
FIG. 7 illustrates a display system according to embodiments of the inventive concepts disclosed herein.

FIG. 7 illustrates another embodiment of a display system 100 according to inventive concepts disclosed herein. The display system 100 illustrated in FIG. 7 is similar to the display system 100 of FIG. 1, except that the format data 124 and 126 is external to the controller 110 in FIG. 7.

Referring to FIG. 7, the display system 100 includes a controller 110 and a OLED display 112. The display 112 includes an array of pixels 114. Each of the pixels 114 includes a plurality of subpixels 116, as shown in FIG. 2. The controller 110 provides a voltage or current to each of the subpixels 116. The luminance of a subpixel 116 increases with the voltage or current applied.

The controller 110 may include a processor 120 and a memory 122. The processor 120 controls voltage or current to be applied to the subpixels 116, according to image data and the data format or formats for the image data. The memory 122 of the controller 110 may include instructions for operation of the processor 120 of the controller.

The system 100 in FIG. 7 further includes a memory 212 which is external to the controller 110. The memory 222 may store the image data and format therefore. FIG. 7 illustrates an example where the memory 212 stores the image data for a first format in a first data format region 124 and image data for a second format in a second data format region 126. The number of data formats and corresponding format regions in the memory is not limited to two, and may be more than two. For a particular image to be displayed on the OLED display 112 at a particular time, each of the subpixels 116 will correspond to one of the data formats.

The embodiments of the inventive concepts disclosed herein have been described in detail with particular reference to preferred embodiments thereof, but it will be understood by those skilled in the art that variations and modifications can be effected within the spirit and scope of the inventive concepts.

What is claimed is:

1. A display system comprising:

an organic light emitting diode (OLED) display comprising an array of pixels, each pixel comprising a first group of subpixels and a second group of subpixels, the first group of subpixels comprising single subpixels of different colors, each of the single subpixels in the first group having a different color than any other of the subpixels in the first group, the second group of subpixels comprising one or more subgroups of subpixels, each subgroup comprising a plurality of subpixels of the same color, all of the pixels of each subgroup having a different color than any of the colors of the first group and any of the colors of any other subgroup; and a controller configured to provide a voltage or current to each subpixel of the OLED display according to a plurality of data formats, wherein according to a first data format, the controller is configured to provide a voltage or current to the first group of subpixels and to a first set of one or more subpixels of each subgroup of the second group, wherein according to the second data format, the controller is configured to provide a voltage or current to at least a second set of subpixels of each subgroup of the second group, and not to the first group of subpixels, wherein the controller selectively actuates the voltage or current provided to the subpixels according to the first data format for charts and data and the second data format for vector colors to reduce a likelihood of burn in of the first set of subpixels, wherein each of the pixels comprises a plurality of blue subpixels in one of the subgroups and the controller selectively actuates the voltage provided to the blue subpixels to reduce burn in of the blue subpixels.

2. The display system of claim 1, wherein the second data format includes data for vector colors and blue sky.

3. The display system of claim 2, wherein the first data format includes data for charts and video.

4. The display system of claim 1, wherein the first data format includes data for charts and video.

5. The display system of claim 1, wherein the subpixel colors include red, green and blue.

6. The display system of claim 1, wherein the subpixel colors include red, green, blue and yellow.

7. The display system of claim 1, wherein the subpixel colors include cyan, magenta, yellow and black.

8. The display system of claim 1, wherein the colors of the first group of subpixels is red and green, and the second group of subpixels comprise a subgroup of blue subpixels.

9. The display system of claim 1, wherein the colors of the first group of subpixels is red and blue, and the second group of subpixels comprise a subgroup of green subpixels.

10. The display system of claim 1, wherein the colors of the first group of subpixels is green and blue, and the second group of subpixels comprise a subgroup of red subpixels.

11. The display system of claim 1, wherein the first group of subpixels has two subpixels.

12. The display system of claim 1, wherein the second group of subpixels comprises one subgroup of subpixels.

13. A display system comprising:

an emissive display comprising an array of pixels, each pixel comprising a first group of subpixels and a second group of subpixels, the first group of subpixels comprising single subpixels of different colors, each of the single subpixels in the first group having a different color than any other of the subpixels in the first group, the second group of subpixels comprising one or more subgroups of subpixels, each subgroup comprising a plurality of subpixels of the same color, all of the pixels of each subgroup having a different color than any of the colors of the first group and any of the colors of any other subgroup; and a controller configured to provide a voltage or current to each subpixel of the emissive display according to a plurality of data formats, wherein according to a first data format, the controller is configured to provide a voltage or current to the first group of subpixels and to a first set of one or more subpixels of each subgroup of the second group, wherein according to the second data format, the controller is configured to provide a voltage or current to at least a second set of subpixels of each subgroup of the second group, and not to the first group of subpixels, wherein the controller selectively actuates the voltage or current provided to the subpixels according to the first data format for charts and data and the second data format for vector colors to reduce a likelihood of burn in of the first set of subpixels, wherein each of the pixels comprises a plurality of blue subpixels and the controller selectively actuates the voltage provided to the blue subpixels to reduce a likelihood of burn in of the blue subpixels.

14. The display system of claim 13, wherein the subpixel colors include red, green and blue.

15. The display system of claim 13, wherein the subpixel colors include cyan, magenta, yellow and black.

16. The display system of claim 13, wherein the colors of the first group of subpixels is red and green, and the second group of subpixels comprise a subgroup of blue subpixels.

17. The display system of claim 13, wherein the first group of subpixels has two subpixels.

18. The display system of claim 13, wherein the first group of subpixels has more than two subpixels.

19. A display system comprising:

an emissive display comprising an array of pixels, each pixel comprising three or more subgroups of subpixels, each subgroup comprising a plurality of subpixels of the same color, all of the pixels of each subgroup having a different color than any of the colors of any other subgroup; and a controller configured to provide a voltage or current to each subpixel of the emissive display according to a plurality of data formats, wherein according to a first data format, the controller is configured to provide a voltage or current to at least a first set of subpixels of each subgroup, wherein according to the second data format, the controller is configured to provide a voltage or current to at least a second set of subpixels of each subgroup, wherein the controller selectively actuates the voltage or current provided to the subpixels according to the first data format for charts and data and the second data format for vector colors to reduce a likelihood of burn in of the first set of subpixels, wherein each of the pixels comprises a plurality of blue subpixels in one of the subgroups and the controller selectively actuates the voltage provided to the blue subpixels to reduce burn in of the blue subpixels.

20. The display system of claim 19, wherein the subpixel colors include red, green and blue.

* * * * *